US005397397A

United States Patent [19]

Awad

[11] Patent Number: 5,397,397

[45] Date of Patent: Mar. 14, 1995

[54] METHOD FOR CLEANING AND DRYING OF METALLIC AND NONMETALLIC SURFACES

[75] Inventor: Sami B. Awad, Drexel Hill, Pa.

[73] Assignee: Crestek, Inc., Trenton, N.J.

[21] Appl. No.: 18,693

[22] Filed: Feb. 17, 1993

Related U.S. Application Data

[63] Continuation-in-part of Ser. No. 947,670, Sep. 18, 1992, abandoned.

[51] Int. Cl.[6] ..... B08B 3/08; B08B 3/12

[52] U.S. Cl. ..... 134/1; 134/3; 134/26; 134/28; 134/41; 134/10

[58] Field of Search ..... 134/1, 2, 3, 10, 26, 134/27, 28, 29, 41

[56] References Cited

U.S. PATENT DOCUMENTS

| | | | |
|---|---|---|---|
| Re. 33,210 | 8/1990 | Stoufer | 252/153 |
| 3,030,238 | 4/1962 | Cohn | 134/26 |
| 3,630,929 | 12/1971 | Dijk | 252/136 |
| 4,156,619 | 5/1979 | Griesshammer | 134/26 X |
| 4,704,225 | 11/1987 | Stoufer | 252/153 |
| 4,787,941 | 11/1988 | Laplaca | 134/26 X |
| 4,859,359 | 8/1989 | DeMatteo et al. | 252/174.15 |
| 4,877,556 | 10/1989 | Wilsberg et al. | 252/544 |
| 4,983,224 | 1/1991 | Mombrun et al. | 134/40 |
| 5,011,620 | 4/1991 | Dishart et al. | 252/118 |
| 5,031,648 | 7/1991 | Lutener et al. | 134/32 |
| 5,041,235 | 8/1991 | Kilbarger | 252/170 |
| 5,112,358 | 5/1992 | Deal, III | 134/26 X |

*Primary Examiner*—Richard O. Dean
*Assistant Examiner*—Saeed T. Chaudhry
*Attorney, Agent, or Firm*—Limbach & Limbach; W. Patrick Bengtsson

[57] ABSTRACT

The present invention relates to an aqueous composition and improved process useful for cleaning and facilitate drying of various metallic and non-metallic surfaces or components. According to the invention the water-immiscible hydrocarbon or non-halogenated organic solvent cleaning step is followed by an aqueous displacement solution (ADS) which contains a surfactant component and a pH modifier component in sufficient amounts to substantially displace the hydrophobic organic solvent residue from on the surface of the substrate and prevent its redeposition. The improved process is an alternative for replacing the ozone depleting chlorofluorocarbons and Halogenated solvents (ODS) or other volatile organic solvents (VOC) being commonly used in cleaning variety of industrially manufactured metallic and non-metallic components. The present invention provides an effective method for removal of various light and heavy surface contaminants such as, but not limited to, fluxes, oils, waxes, buffing and lapping compounds, finger prints, silicone oils, metal forming lubricants, polymers and mold release compounds.

2 Claims, No Drawings

METHOD FOR CLEANING AND DRYING OF METALLIC AND NONMETALLIC SURFACES

CROSS-REFERENCE TO RELATED APPLICATION

This is a continuation-in-part of application Ser. No. 07/947,670, filed on Sep. 18, 1992 in the name of the same inventor, now abandoned.

FIELD OF THE INVENTION

The present invention relates to an aqueous composition and improved process useful for cleaning and drying of various metallic and non-metallic surfaces or components. The improved process provides an alternative to replace the ozone-depleting chlorofluorocarbons, halogenated solvents and other volatile organic solvents (VOC) commonly used. The present invention provides an effective method for removal of various light and heavy surface contaminants such as fluxes, oils, waxes, buffing and lapping compounds, finger prints, silicone oils, metal forming lubricants, polymers and mold release compounds.

BACKGROUND OF THE INVENTION

Petroleum or synthetic hydrocarbons solvents as well as natural terpene hydrocarbon solvents or mixtures thereof, with or without other modifier additives, were recently reconsidered and commercialized as long-term alternative cleaning agents for the widely used, but gradually being phased out, chlorofluorocarbons (CFCs) (example 1,1,2-trichloro-1,2,2-trifluoroethane) and other halogenated solvents such as dichloromethane, carbon tetrachloride, 1,1,1-trichloroethane, 1,1,2-trichloroethylene and perchloroethylene. These solvents are used in cleaning fluxes from printed circuit boards (PCBs) and cleaning of various machine oils used in the manufacture of different metallic and non-metallic components (degreasing/vapor degreasing processes) as well as for cleaning other contaminants such as particulates, buffing, polishing, lapping compounds, waxes, paints. The CFCs and the halogenated solvents are known to deplete the stratospheric ozone layer.

Ozone depletion leads to increasing the infiltrated ultraviolet radiation, which in turn increases potential incidents of cataracts, skin cancers and other human and ecological problems. The global consensus on an accelerated phaseout of materials with ozone depleting potential (ODP) is mounting. It has culminated recently in the "Montreal Protocol on Substances that Deplete the Ozone Layer" and in the revisions to accelerate the time limit for ending their production.

The cleaning process using CFCs (or their azeotropic mixtures with protic solvents) or chlorinated solvents involves immersing the components to be cleaned in the solvent which is heated and ultrasonically cavitated for certain period of time. Then, the components are exposed to solvent vapor for secondary cleaning and rinsing. Following this step, the components are removed and left to air dry. The CFCs and some chlorinated solvents have two main advantages in this process because they are non-flammable and volatile at ambient or low temperature. Thus, drying of the components is not problematic. Also, some CFCs were commonly used to dry some aqueously cleaned surfaces through surface water-film displacement in a drying machine known as the CFC dryer.

In contrast to CFCs, and halogenated solvents, water immiscible petroleum, synthetic and/or natural terpene hydrocarbons or hydrocarbons modified with other additives or surfactants are increasingly used as alternative sources for the cleaning of metallic and non-metallic surfaces. However, these solvents are always accompanied with rinsing and drying problems. Briefly, the cleaned surfaces are difficult to rinse and to dry and consequently, require prolonged drying times and relatively high temperatures. Drying of these solvents at high temperatures is associated with potential fire or environmental hazards, particularly those with low flash point solvents. Similar problems have also been found for surfaces cleaned with other water immiscible non-halogenated solvent cleaners including medium-high molecular weight alcohols, ethers, amines, esters and derivatives or mixtures.

The above identified problems are attributed to the inherent properties of these hydrophobic solvents and circumstances related to their uses. For example, rinsing or displacement of surfaces cleaned with these solvents is difficult because of their inherent lower surface tension. Furthermore, these non-halogenated solvents tend to leave a very thin organic film, after cleaning and drying, absorbed on the surfaces which negatively interferes in many cases with the next step in a multi-step surface preparation such as coating, etching or vacuum coating deposition. Also, in some instances the cleaning solution contains surfactants which tend to undesirably emulsify the hydrocarbon solvent on rinsing with water in order to remove it, rendering phase separation of the solvent unfeasible for subsequent collection and recycling.

It has been shown that several water rinse steps using plural rinses, following a cleaning step with either water-immiscible or water-emulsifiable or dispersable non-halogenated solvent cleaners at different temperatures, failed to completely remove the undesirable residue of the organic solvents in the relatively short time which is demanded by typical production requirements. The incomplete removal of the water-immiscible non-halogenated solvent film therefore renders many metallic and non-metallic surfaces, undesirably, water repellant or hydrophobic.

Complete removal of the non-halogenated or hydrocarbon base solvent residues is essential, particularly in cleaning and drying of metals and non-metals with different configurations that are manufactured to be used in the electronic industry. Also, subsequent processes such as etching, plating, coating, vacuum vapor deposition or painting require water break-free or hydrophilic surfaces to produce good results. Otherwise, the surface may suffer differential etching or coat adhesion problems respectively. Furthermore, a partially hydrophobic surface tends to repel the rinse water leaving water droplets on the surface which may dry in place leaving residual marks on drying. Moreover, the residual unrinsed non-halogenated solvent may contain some of the original surface contaminants. On the other hand, a water break-free surface drains the rinse water faster and requires less energy and time to dry.

Metallic and non-metallic substrates which were first cleaned with a water immiscible (or partially water emulsifiable), heated, hydrocarbon base or non-halogenated solvent concentrate, by immersion in ultrasonically cavitated bath or which were submerged sprayed or simply dipped in with vertical or horizontal oscillation or rotation followed by rinsing with water, or a water diluted emulsion of the same hydrocarbon or non-halogenated solvent, ultrasonically cavitated, or sprayed or submerged sprayed followed by multi water rinses, failed to produce surfaces which are entirely free from the hydrophobic solvent residues. These residues may leave an undesirable residual odor of the natural or non-halogenated or petroleum hydrocarbon solvent or included additives; or interfere with the next step in a manufacturing operation process as mentioned above. Furthermore, the residual hydrocarbon or non-halogenated solvent with low flash point may create a fire-hazard if enough accumulates in the drying step which commonly uses recycled heated air. Air or inert gas drying techniques of those solvents require expensive and complex safeguards against fire hazard and to minimize their vapor release to the environment.

It is therefore highly desirable to have an improved process and aqueous composition for the cleaning and drying of metallic and non-metallic surfaces which overcomes the above-noted drawbacks resulting from the incomplete removal of the hydrocarbon or non-halogenated solvent. The present invention diminishes the potential for a fire-hazard or an explosion, as well as reduces the drying time by effectively removing the non-halogenated organic solvent residues or other flammable water-immiscible cleaning solvents. Furthermore, the invention diminishes the drag-out or carry over of these solvents on parts, therefore, allows efficient and economic rinse-water recovery through closed loop purification systems. Typical purification systems include activated carbon to remove organic residues. The carbon has certain loading capacity for organics before exchange or disposal.

Prior art related to the process and composition for the cleaning and drying of various surfaces has been disclosed in several patents. U.S. Pat. No. 5,041,235 describes a cleaning composition to clean porous surfaces containing a low molecular weight alcohol, synthetic hydrocarbon oil and a surfactant. U.S. Pat. No. 5,031,648 describes a spray method to clean mill gears soiled with gear lubes, greases and hardened residues with a composition containing a terpene hydrocarbon, aliphatic hydrocarbon solvent, surfactants, extreme pressure additive, thickeners and co-solvent followed by rinsing with a water-emulsifier soap solution in a pressure washer. U.S. Pat. No. 5,011,620 describes a cleaning composition of dibasic ester solvent and hydrocarbon solvent for cleaning flux residue from a printed circuit board. U.S. Pat. No. 4,983,224 describes a cleaning composition of terpenes/terpenols and polar aprotic solvents and a surfactant for cleaning fluxes. U.S. Pat. No. 4,877,556 discloses a cleaning composition of ethoxylated fatty alcohol, fatty acid ester, a monohydric alcohol, and liquid hydrocarbon for pretreatment of soiled fabrics before washing. U.S. Pat. No. 4,859,359 describes a composition which imparts water repellency to hard surfaces. The disclosed composition comprises a solvent mixture of glycol ether, a lower aliphatic alcohol, a hydrocarbon solvent and organic polysiloxane. U.S. Pat. No. 4,704,225 and Re. No. 33,210 describe a cleaning composition of terpene hydrocarbon, and a coconut oil fatty acid alkanolamide (an emulsifier) having water dispersed therein, water-in-oil emulsion.

There is no disclosure in the above-noted patents which would tend to suggest or otherwise provide motivation for employing a water-immiscible solvent cleaner followed by a solvent displacement/cleaning step, before the water rinsing step, which utilizes a biodegradable and environmentally benign, aqueous composition capable of producing hydrophilic surfaces and also phase separates the water-immiscible solvent for recovery or recycling, and expedites the drying of the cleaned parts.

SUMMARY OF THE INVENTION

It has been found that the above objectives are accomplished by a process and an aqueous displacement solution composition according to the invention in which, the water-immiscible non-halogenated or hydrocarbon solvent cleaning step is followed by an aqueous displacement solution (ADS) which contains a surfactant component and a pH modifier component in sufficient amounts to substantially displace the hydrophobic hydrocarbon or non-halogenated organic solvent residue from the surface of the substrate and prevent its redeposition. The displacement of the hydrophobic hydrocarbon or non-halogenated organic solvent residue was found to be greatly enhanced by cavitating the ADS with an ultrasonic energy. The removed hydrocarbon or non-halogenated organic solvent residue coalesce to form an upper phase which can be overflown into a separator from which the hydrocarbon is removed and recycled. The aqueous solution phase is recycled to the original aqueous displacement solution bath.

This hydrocarbon, or organic solvent, aqueous displacement step is followed by one or more water rinse steps, using air spray or submerged spray, oscillation, rotation, with or without ultrasonic energy cavitations where the aqueous displacement film is freely removed. A drying step follows in which the water film residues wetting the cleaned substrates are dried using heated air or other drying technique.

The process of this invention may be used in cleaning of various metallic components such as metals and their alloys including, but not limited to, steel, aluminum, copper, titanium, beryllium, silver, gold, nickel, and non-metallic substrates including, but not limited to, glass, silicones and ceramics. Some examples of contaminants successfully and completely removed are Rigidax (high melting point wax component and additives) from a metal surface; a filling compound made of rubber gel in mineral oil base modified with olefin polymer from communication cable wires; heavy machining slurry composed of silicon and silicon carbide in a viscous cutting mineral oil from silicon wafers; various machining, tapping and stamping oils; silicon oils; highly viscous sulfurized heat treat oils used for hardening metals and lapping compounds mixed with oils.

DESCRIPTION OF THE INVENTION

It is an objective of the invention to provide an improved process and aqueous displacement solution (ADS) for the cleaning and drying of metallic and non-metallic surfaces which overcomes the above-noted drawbacks resulting from the incomplete removal of the hydrocarbon or non-halogenated solvent or other water-immiscible non-halogenated organic cleaning solvents. It is another objective to diminish the potential fire-hazard or an explosion while reducing the drying time by effectively removing the non-halogenated organic solvent residues or other water-immiscible cleaning solvents. It is a further objective to minimize the drag-out or the carry-over of the hydrocarbon or non-halogenated solvent into the rinses which increases the efficiency and the lifetime of the rinse water closed loop purification systems, thus minimizing waste and preserving water.

The sequence of the cleaning operational steps in relation to this invention is as follows. Each step comprises one or plural steps. Each step may comprise immersion in ultrasonic bath or mechanical agitation or air spray or submerged spray and heat:

1. Solvent cleaning step using a pure hydrocarbon or hydrocarbon base product or other water immiscible non-halogenated solvent, which solublizes and dislodges the contaminants on the surface, using sufficient heat and residence time. Agitation, oscillation or rotation or pressurized spray or submerged spray or ultrasonics or combination thereof is used.

2. Solvent displacement with an ADS using agitation, oscillation or rotation or pressurized spray or submerged spray or ultrasonics or combination plus sufficient heat and residence time.

3. Rinse with deionized water using agitation, oscillation or rotation or pressurized spray or spray under immersion or ultrasonics or combination plus sufficient heat and residence time. Other types of water may be used such as distilled, softened water, recycled water purified through a system includes activated carbon beds and ion exchange resin beds or through a membrane by reverse osmosis or ultra filtration or simply tap water.

4. Drying. For expediency and handling of production rates, the preferred non-solvent drying technique of choice uses recirculated forced ambient or heated air with or without filtration. Other common drying methods may utilize infra-red heating, centrifuging, and vacuum drying or simply ambient forced air dry or combination thereof. Flat non-metal parts with no blind holes can be dried by immersion in heated water followed by slow vertical ascent withdrawal.

In each of the first three steps one or more means is used to agitate the solution and/or to scrub the surface such as ultrasonic cavitations, pressurized spray or preferably spray under the cleaner surface or ADS surface or the rinse water surface. In step one, subsurface spray is preferred over pressurized air spray to minimize mist formation and the associated potential for fire or environmental hazard. The substrates may be kept in continuous motion utilizing tumbling, vertical or horizontal oscillation or rotation. Drying temperatures are sometimes dictated by the nature of the substrate.

The cleaning process comprises displacing the hydrocarbon or the non-halogenated solvent residues on the surface with an acidic or neutral or alkaline aqueous solution comprising at least one surfactant added in sufficient amount in a separate step in the process before the water rinsing. The surfactant(s) preferably has low emulsification power for the hydrocarbon solvent or other non-halogenated water immiscible organic solvents.

The aqueous displacing solution for use in accordance with this invention is preferably formulated so as to displace the water immiscible hydrocarbon solvent or the non-halogenated organic film on the metallic or non-metallic substrate with a water rinsable film, so that the substrate may subsequently freely rinsed with water and dried off in a shorter time. The general formula for the ADS according to the present invention, expressed as percent by weight, comprises one or more surfactants in an amount of about 0.01 to about 50 percent by weight, preferably, 0.01–10%, more preferably 0.01 to 1%; and/or an ionic surfactant in an amount of about 0.01 to about 50 percent by weight of said composition, preferably 0.01 to 10%, more preferably 0.01 to 1%; and a pH modifier in an amount of about 0.00001 to about 10 percent by weight of said composition. However, it is understood that the general formula can be varied as expressed as percent by weight based on the purpose of usage.

Preferred surfactants for use in accordance with the present invention are nonionic surfactants and anionic surfactants with low emulsification power for hydrocarbons or other water immiscible non-halogenated solvents. Particularly preferred nonionic surfactants include alkyl, alkylaryl or aryl glucosides and their alkyloxylated glucoside derivatives and alkyloxylated fatty alcohols or ethers. The aqueous displacing component formulations may comprise other optional anionic, nonionic surfactants or other additives.

Examples are fatty esters, amines, diesters, amides, ethers and derivatives thereof with or without alkyloxylation and with or without termination.

Particularly preferred anionic surfactants include alkyl or alkylaryl or aryl (with or without alkyloxylation) sulfates and sulfonates and phosphate esters and fatty acid salts. Other anionic components surfactants such as phosphonate acid or esters and fatty acids, diacids and polyacids and salts and derivatives with or without alkyloxylation may be used as optional ingredients to modify the ADS of the invention.

Preferred anions for use to modify the pH in accordance with the present invention include hydroxides, carbonate, bicarbonate and phosphates of metals in group I & II elements. Other preferred pH modifiers include ammonia and ammonium salts or water soluble primary, secondary or tertiary amines with or without alkyloxylation and with or without termination.

The preferred solvent aqueous displacing solution (ADS) in this invention comprises at least one anionic or one nonionic surfactant and at least one pH modifier and composed in sufficient amounts.

The pH modifier is intended for the purpose of enhancing the hydrophobe displacement and its phase separation. In addition, the pH modifier is important to bring the pH to the desired level so that no harm such as undesired surface etch is done to the substrate. Preferred acids for use to modify the pH in accordance with the present invention include mineral acids and organic acids or polyacids with low molecular weight. More preferred acids or their partially neutralized or ammonium salts include sulfuric acid, nitric acid, phosphoric acid, hydrofluoric acid, formic acid, acetic acid, gluconic acid, glycolic acid, oxalic acid, tartaric acid and citric acid.

One clear advantage of the present invention is the shortening of the drying time. For example, the drying time of a non-halogenated hydrocarbon solvent with relatively low vapor pressure can be reduced from 3 hours to 30 minutes when ADS is used as compared to deionized water (See EXAMPLE 6). The typical drying time under the temperatures ranging from 180° to 225° F. is between 1 to 10 minutes depending on several variables.

The substrate surface is tested for the water immiscible solvent removal by examining the surface for complete wettability or for water-break free surface by immersing the substrate, after the final water rinse, in an ambient deionized water followed by pulling it up slowly and observing any fast dewetting or shrinking spot(s). The degree of wettability is then determined versus the total surface area of the substrate. The degree of wettability according to the present invention is equal to the percentage of the surface divided by the total surface area.

The present invention will be better understood from the examples which follow, all of which are intended to be illustrative only and not meant to unduly limit the scope of the invention.

EXAMPLE 1

Table 1 summarizes the results obtained from cleaning various substrates (metallic and non-metallic) with different cleaning compositions according to this invention. Substrates were used after contaminating the surface with a thin film of about 2 mg/cm2 surface area of a mineral based machining oil. The oil (Amocut Tripur Cutting oil from Amoco, Chicago, Ill.) was spread evenly on the whole surface of the substrate.

Substrates:

1. Stainless steel (316-L) 2"×4" panels
2. Aluminum (6061) 2"×4" panels
3. Glass plates 4"×4"
4. Thin Ceramic plates 2"×4" (used for manufacturing electronic circuit boards)
5. Thin Silicone wafers 4"×4" (parts for manufacturing solar energy panels)

TABLE 1

| Substrate Wettability | Solvent Cleaner | ADS | /Wash /Time | % Wettability with agitation | % with U/S |
|---|---|---|---|---|---|
| I. Stainless Steel | 1 | A | 60 | 5 | 80 |
| | 1 | A1 | 60 | 90 | 100 |
| | 2 | B | 60 | 15 | 100 |
| | 3 | C | 60 | 70 | 100 |
| | 4 | D | 30 | 85 | 100 |
| | 5 | E | 30 | 70 | 100 |
| II. Aluminum | 1 | A | 60 | 5 | 75 |
| | 1 | A1 | 60 | 90 | 100 |
| | 2 | B | 45 | 25 | 95 |
| | 3 | C | 60 | 95 | 100 |
| | 4 | D | 30 | 30 | 100 |
| | 5 | E | 30 | 50 | 100 |
| III. Silicone Wafers | 1 | A | | 50 | 90 |
| | 1 | A1 | | 85 | 100 |
| | 2 | B | 45 | 90 | 100 |
| | 3 | C | 60 | 85 | 100 |
| | 4 | D | | 85 | 100 |
| | 5 | E | 45 | 75 | 100 |
| IV. Glass | 1 | A | | 70 | 100 |
| | 1 | A1 | | 85 | 100 |
| | 2 | B | 45 | 90 | 100 |
| | 3 | C | 60 | 25 | 100 |
| | 4 | D | 30 | 70 | 100 |
| | 5 | E | | 50 | 75 |
| V. Ceramic | 1 | A | | 40 | 90 |
| | 1 | A1 | | 60 | 100 |
| | 2 | B | 45 | 95 | 100 |
| | 3 | C | 60 | 90 | 100 |
| | 4 | D | | 90 | 100 |
| | 5 | E | | 80 | 100 |

1. Bioact ® EC-7R. An orange terpene hydrocarbon (Petroferm Inc., Fernandina Beach, FL).
2. THO-130. A hydrotreated light petroleum distillate (Sun Refining and Marketing Company, Philadelphia, PA).
3. Axarel ® 9100. A mixed aliphatic hydrocarbons and aliphatic esters (E. I. du Pont, Wilmington, DE).
4. Exxate ® 1000. Water immiscible C10 branched-chain synthetic ester (Exxon Chemical Americas, Houston, TX).
5. Actrel ® 4493-L. Aliphatic petroleum hydrocarbon (Exxon Chemical Americas, Houston, TX).

A: Nonylphenoxyethoxyethanol (1% by weight).

A1: Nonylphenoxyethoxyethanol (1% by weight) and potassium hydroxide (0.005% by weight), pH is about 9–11.

B: Chem Crest 165 (Crest Ultrasonics, Trenton, N.J.), a mixture of anionic surfactant, citric acid and ammonium citrate and formaldehyde condensate, pH is about 5–7.

C: Chem Crest 211 (Crest Ultrasonics, Trenton, N.J.), a mixture of anionic and nonionic surfactants, triethanolamine and sodium metasilicate, pH is about 10–12.

D: Composition : Ethal DA-9, nonionic surfactant (Ethox Chemicals, Greensborough, N.C.); Triton CG-110 a polyglucoside nonionic surfactant (Union Carbide, Danbury, CT) and sodium carbonate, pH is about 8–9.

E: Chem Crest 55 from Crest ultrasonics, a mixture of nonionic surfactant, glycol ether, amine salt and phosphoric acid, pH is about 1–5.

EXAMPLE 2

Table 2 below illustrates the removal of the solvent cleaner from on the substrates, prepared as described in example 1, when sprayed rinsed with water, at 120° F. and when rinsed in sonicated overflowing water, at 120° F., for 60 seconds.

TABLE 2

| Substrate | Solvent | % Wettability spray rinse | % Wettability sonicated rinse |
|---|---|---|---|
| I. Stainless Steel | 5 | 5 | 25 |
| II. Aluminum | 1 | 5 | 70 |
| | 5 | 15 | 75 |
| III. Silicone | 5 | 20 | 70 |
| IV. Glass | 5 | 5 | 20 |

EXAMPLE 3

The following example (Table 3) illustrates the improvement in the removal of solvent residues using this invention. The solvent used in this example is Axarel ® 9100 (E. I. dupont, Wilmington, Del.). This solvent cleaner is composed of mixed aliphatic hydrocarbons, aliphatic esters. The substrates were used after contaminating the surface with a thin film of about 2 mg/cm2 surface area of a mineral oil based machining oil. The oil was spread evenly on the whole surface of the substrate. The substrates were immersed in a circulated Axarel liquid concentrate heated at 150° F. for 1 minute, rinsed with water for 10 seconds, immersed in agitated solution of an aqueous cleaner composition according to this invention heated at 140° F. for 45 seconds and then rinsed with water spray at 110° F. for 45 seconds.

TABLE 3

| Substrate | ADS* | % Wettability with no sonics | % Wettability with sonics |
|---|---|---|---|
| 1. Stainless Steel | No | 25 | |
| | Yes | 95 | 100 |
| 2. Silicon wafer | No | 25 | |
| | Yes | 95 | 100 |
| 3. Silicone | No | 5 | |
| | Yes | 95 | 100 |
| 4. Glass | No | 70 | |
| | Yes | 95 | 100 |

TABLE 3-continued

| Substrate | ADS* | % Wettability with no sonics | % Wettability with sonics |
|---|---|---|---|
| 5. Aluminum | No | 10 | |
| | Yes | 70 | 100 |

*The aqueous cleaner is composed of sodium naphthalene sulfonate, citric acid, ammonia and potassium hydroxide. pH of the aqueous cleaning solution was about 6-8.

Substrates:
1. Stainess steel (316-L) 2" × 4" panels;
2. Thin Silicone wafers 4" × 4";
3. Glass plates 4" × 4";
4. Thin Ceramic plates 2" × 4";
5. Aluminum (6061) 2" × 4" panels.

EXAMPLE 4

The following industrially manufactured components were processed according to the invention. Each group of substrates were subjected to the process described below. In each case the substrates were examined for complete removal of the contaminants and for complete wettability.

1. Brass pin eyelets. Contaminant is starine wax soldering flux.

2. Cylindrical metal plated electronic capacitors of various sizes. Contaminants are machining mineral oil and welding RMA flux.

The parts were placed in a suitable stainless steel flat or electrically driven rotating basket and processed as follows:

(1). The parts were immersed in a 10"×14"×10" ultrasonic stainless steel tank (Manufacturer: Crest Ultrasonics, Trenton, N.J.) filled with Axarel® 32 solvent cleaner (E. I. du Pont, Wilmington, Del.), at 160°-170° F., for 5-10 minutes. This solvent cleaner is composed of mixed aliphatic hydrocarbons, aliphatic esters and nonionic surfactants. The ultrasonic bath transducers were powered by a Genesis SA generator at 90 watts/gallon and sweep frequency of 38-42 Khz.

(2). The parts were allowed to drain the excess hydrocarbon solvent for 30 seconds and then immersed in another similar 10"×14"×10" ultrasonic tank charged with Chem Crest 103, a mild alkaline solution (Crest Ultrasonics, Trenton, N.J.; pH=8-9.5, a mixture of nonylphenoxyethoxyethanol, coconut diethanolamide/diethanolamine and hexylene glycol), at 4% concentration and heated at 140°-150° F. for 5 minutes. The ultrasonic transducers were powered by a Genesis generator at 90 watts/gallon and sweep frequency of 39-41 Khz.

(3). The parts were allowed to drain the aqueous cleaner for 30 seconds and then sprayed with deionized water then immersed in another similarly ultrasonically powered tank charged with overflowing deionized water at a rate of 1 gallon/minute and heated at 100°-110° F. for 2 minutes.

(4). The parts were allowed to drain for 30 seconds and then immersed in another similar ultrasonically powered overflowing tank charge with deionized water which was heated at 100°-110° F. for w minutes. The parts exit between deionized water spraying headers and were then allowed to drain for 30 seconds.

(5). The parts were exposed to air blowoff knives for 15 seconds before immersion in a circulated hot air dryer heated at 190°-210° F. Sample of the parts were examined for wettability after step number 4 by fully immersion in a deionized water and were found fully wettable. The parts were examined for unremoved flux under long wave ultraviolet light or visually under a stereo microscope at 10-45 magnification and were found free from any residues. It was noted that the Axarel 32 phase separated and on the surface of the aqueous displacement solution in step (2), where it was moved into a separation tank or a decanter.

EXAMPLE 5

The following industrially manufactured components were processed according to the invention. Each group of substrates were subjected to the process described below. In each case the substrates were examined for complete removal of the contaminants and for complete wettability.

1. Ingot 10"×4"×5" of machined silicone wafers. Surface contaminants are SAE 30 mineral oil, silicone particles and silicone carbide.
2. Titanium and steel impellers 7" and 10" diameter. Contaminant is thick green wax (Rigidax) compound.
3. Stainless steel and brass pin points. Contaminant is heavy cutting mineral oil product.

The parts were placed in a suitable stainless steel flat or electrically driven rotating basket and processed as follows:

(1). The parts were immersed in a 10"×14"×10" stainless steel tank with two parallel spray headers installed close to the bottom of the tank and powered by a chemically resistant pump (Manufacturer: Crest Ultrasonics, Trenton, N.J.). The tank was filled with Axarel 9100 solvent cleaner (From E. I. du Pont, Wilmington, Del.) and heated at 165°-175° F. The parts were then subjected to the submerged spray for 5-10 minutes.

(2). The parts were allowed to drain the excess hydrocarbon solvent for 30 seconds and then immersed in another similar 10"×14"×10" ultrasonic tank charged with Chem Crest 103, a mild alkaline cleaner or Chem Crest 211 alkaline cleaner (from Crest Ultrasonics, Trenton, N.J.), at 5% concentration and heated at 140°-150° F. for 5-10 minutes. The ultrasonic transducers were powered by a Genesis generator at 90 wats/gallon and sweep frequency of 39-41 Khz.

(3). The parts were allowed to drain the aqueous cleaner for 30 seconds and then sprayed with deionized water than immersed in another similar ultrasonically powered tank charged with overflowing deionized water at a rate of 1 gallon/minute and heated at 100°-110° F. for 2 minutes.

(4). The parts were allowed to drain for 30 seconds and then immersed in another similar ultrasonically powered overflowing tank charged with deionized water which was heated at 100°-110° F. for 2 minutes. The parts exit between deionized water spraying headers and were then allowed to drain for 30 seconds.

(5). The parts were exposed to air blowoff knives for 15 seconds before immersion in a circulated hot air dryer heated at 190°-210° F. Sample of the parts were examined for wettability after step number 4 by fully immersion in a deionized water and were found fully wettable. The parts were examined for unremoved oil contaminants under long wave ultraviolet light or visually under a stereo microscope at 10-45 X magnification or by the clean cloth wipe test were found free from any residues. It was noted that the Axarel 9100 phase separated on the surface of the aqueous cleaner in step 2, where it was removed into a separation tank or a decanter. Using a circulating pump connected to the tank where the return solution is pumped close to the solution at slow rate, the floating hydrocarbon solvent was sparged out to a decanter. The solution was allowed to phase separate and the aqueous cleaner solution was returned to tank 2. The hydrocarbon solvent is optionally returned to tank 1 or collected and distilled under vacuum for reuse or collected for proper waste disposal.

EXAMPLE 6

The following industrially manufactured components were processed according to the invention. Each group of substrates were subjected to the process described below. In each case the substrates were examined for complete removal of the contaminants and for complete wettability.

1. Chrome plated steel piston rings. Contaminants are mineral oil, lapping compound, silicone carbide.
2. Semicircular flat galvanized steel wires of various diameters. Contaminant is a highly viscous sulfurized heat treat oil.

The parts were placed in a suitable stainless steel fixture and processed as follows:

(1). The parts were immersed in a 10"×14"×10" ultrasonic stainless steel tank (Manufacturer: Crest Ultrasonics, Trenton, N.J.). The ultrasonic bath transducers were powered by a Genesis ® SA generator at 90 watts/gallon and sweep frequency of 38–42 Khz (Manufacturer: Crest Ultrasonics, Trenton, N.J.). The tank is also fitted with a deeply seated spray headers connected to a chemically resistant circulating pump to spray the solvent under its surface. The rank was filled with Axarel ® 9100 solvent cleaner (From E. I. du Pont, Wilmington, Del.), at 150°–160° F. The parts were first submerged sprayed for 3 minutes and then turned off and the sonics were turned on for 2 minutes then the sequence was repeated one more time.

(2). The parts were allowed to drain the excess hydrocarbon solvent for 30 seconds and then immersed in another similar 10"×14"×10" ultrasonic tank charged with Chem Crest 211 (From Crest Ultrasonics, Trenton, N.J.), at 5% concentration and heated at 140°–150° F. for 5–10 minutes. The ultrasonic transducers were powered by a Genesis ® generator at 90 watts/gallon and sweep frequency of 39–41 Khz.

(3). The parts were allowed to drain the aqueous cleaner for 30 seconds and then sprayed with deionized water than immersed in another similar ultrasonically powered tank charged with overflowing deionized water at a rate of 1 gallon/minute and heated at 100°–110° F. for 2 minutes.

(4). The parts were allowed to drain for 30 seconds and then immersed in another similar ultrasonically powered overflowing tank charged with deionized water which was heated at 100°–110° F. for 2 minutes. The parts exit between deionized water spraying headers and were then allowed to drain for 30 seconds.

(5). The parts were exposed to air knives for 15 seconds before immersion in a circulated hot air dryer heated at 190°–210° F.

Sample of the parts were examined for wettability after step number 4 by fully immersion in a deionized water and were found fully wettable. The parts were examined for unremoved oils under long wave ultraviolet light or examined visually under the microscope at 10–45 X or by the clean wipe cloth test and were found free from any residues. It was noted that the Axarel ® 9100 separated on the surface of the aqueous displacement solution step (2), where it was removed into a separation tank or a decanter.

EXAMPLE 7

This example illustrates the improvement in drying time according to this invention. Telecommunication exposed cable end wires filled with extended thermoplastic rubber gel modified with olefinic polymers were processed according to this invention as follows.

A cable end was placed in a suitable stainless steel fixture and processed as follows. Material of construction limited the maximum temperature to 135° F.

Process A

1. The cable end wires were immersed in a 12"×18"×12" stainless steel tank (Manufacturer: Crest Ultrasonics, Trenton, N.J.). The tank is fitted with a deeply seated spray headers connected to a chemically resistant circulating pump to spray the solvent under its surface. The tank was filled with Axarel ® 9100 solvent cleaner (From E.I. du Pont, Wilmington, Del.), at 150°–160° F. The parts were submerged sprayed for 10 minutes at 130° F. with vertical oscillation.

2. The cable end wires were allowed to drain the excess hydrocarbon solvent for 3 minutes and then immersed in another similar 12"×18"×12" ultrasonically activated tank charged with Chem Crest 211 (From Crest Ultrasonics, Trenton, N.J.), at 5% concentration heated at 135° F. for 5 minutes. The ultrasonic transducers were powered by a Genesis generator at 90 watts/gallon and sweep frequency of 39–41 Khz.

3. Step 2 was repeated in another similar tank under the same set of conditions.

4. The cable end wires were allowed to drain the aqueous cleaner for 1 minute and then sprayed with deionized water then immersed in another similar ultrasonically powered tank charged with overflowing deionized water at a rate of 1 gallon/minute and heated at 135° F. for 3 minutes 5. The cable end wires were subjected to deionized water air spray for 2 minutes and then allowed to drain for 30 seconds.

6. The cable was immersed in a circulated hot air dryer heated at 135° F. for 30 minutes.

Process B

1. A cable end was immersed in a 12"×18"×12" stainless steel tank (Manufacturer: Crest Ultrasonics, Trenton, N.J.). The tank is fitted with a deeply seated spray headers connected to a chemically resistant circulating pump to spray the solvent under its surface. The tank was filled with Axarel ® 9100 solvent cleaner (From: E.I. du Pont, Wilmington, Del.), at 150°–160° F. The parts were submerged sprayed for 10 minutes at 130° F. with vertical oscillation.

2. The cable was allowed to drain for 3 minutes and then immersed in a circulated air dryer heated at 135° F. for 3 hours.

Process C

1. A cable end was immersed in a 12"×18"×12" stainless steel tank (Manufacturer: Crest Ultrasonics, Trenton, N.J.). The tank is fitted with a deeply seated spray headers connected to a chemically resistant circulating pump to spray the solvent under its surface. The tank was filled with Axarel ® 9100 solvent cleaner (From: E.I. du Pont, Wilmington, Del.), at 150°–160° F.

The parts were submerged sprayed for 10 minutes at 130° F. with vertical oscillation.

2. The cable was allowed to drain and air dry under the hood for 48 hours.

Each processed cable end wires was examined visually and by wiping the wires with a clean cloth for dryness and residual gel. The wires of the cable end according to process A was completely clean and dry. Residual Axarel solvent was detected on both of the cable wires cleaned according to processes B and C.

What is claimed:

1. A cleaning process comprising the sequential steps of:

(a) contacting a contaminated surface with a solvent selected from the group consisting of orange terpene hydrocarbon, hydrotreated light petroleum distillate, mixed aliphatic hydrocarbons and aliphatic esters, $C_{10}$ branched chain synthetic ester and aliphatic petroleum hydrocarbon;

(b) heating and ultrasonically agitating said surface with said solvent;

(c) displacing said solvent from said surface and rendering said surface hydrophilic by applying an aqueous solution containing a surfactant and pH modifier to said surface, said surfactant being selected from the group consisting of nonylphenoxyethoxyethanol, polyglucosides, anionic surfactants, nonionic surfactants and mixtures thereof having low emulsification power for said solvent, the pH modifier being selected from the group consisting of hydroxides, carbonate, bicarbonate, phosphates of metals in groups I and II elements, ammonia, ammonium water soluble primary amines, water soluble secondary amines, water soluble tertiary amines, mineral acids, organic acids, polyacids, sulfuric acid, nitric acid, phosphoric acid, hydrofluoric acid, formic acid, acetic acid, gluconic acid, glycolic acid, oxalic acid, tartaric acid and citric acid;

(d) rinsing, heating and agitating said surface with water; and (e) drying said surface.

2. A cleaning method according to claim 1 comprising the additional steps of:

(f) separating an aqueous phase from a solvent containing liquid remaining after step (d);

(g) recycling said solvent for use in step (a); and (h) recycling said aqueous phase for use in step (c).

* * * * *